US008319137B2

(12) United States Patent
Ren

(10) Patent No.: US 8,319,137 B2
(45) **Date of Patent: *Nov. 27, 2012**

(54) VACUUM SWITCH TUBE

(75) Inventor: Jianchang Ren, Beijing (CN)

(73) Assignee: Beijing Orient Vacuum Electric Co., Ltd., Beijing (CN)

( * ) Notice: Subject to any disclaimer, the term of this patent is extended or adjusted under 35 U.S.C. 154(b) by 398 days.

This patent is subject to a terminal disclaimer.

(21) Appl. No.: 12/698,865

(22) Filed: Feb. 2, 2010

(65) Prior Publication Data

US 2011/0186547 A1 Aug. 4, 2011

(51) Int. Cl.
*H01H 33/66* (2006.01)

(52) U.S. Cl. ..... 218/127; 218/146

(58) Field of Classification Search ..... 218/10, 218/118, 121, 123–128, 146
See application file for complete search history.

(56) References Cited

U.S. PATENT DOCUMENTS

| | | | | |
|---|---|---|---|---|
| 4,021,633 | A * | 5/1977 | Kuwabara et al. | 200/262 |
| 4,636,600 | A * | 1/1987 | Lipperts | 218/129 |
| 5,254,817 | A * | 10/1993 | Inagaki | 218/132 |
| 2004/0035827 | A1* | 2/2004 | Ren | 218/123 |
| 2004/0035828 | A1* | 2/2004 | Jianchang | 218/123 |
| 2011/0042354 | A1* | 2/2011 | Blalock et al. | 218/29 |

* cited by examiner

*Primary Examiner* — Amy Cohen Johnson
*Assistant Examiner* — Marina Fishman
(74) *Attorney, Agent, or Firm* — J.C. Patents

(57) ABSTRACT

The present invention relates to a vacuum switch tube, which includes a first contact and a second contact disposed on conductive rods respectively. The two contacts are disposed facing each other. The two contacts are cylinders and include conductive members and magnetic members to form contact bodies. The cross section shape of the magnetic members is divided by a neutrality line into two unequal regions. The magnetic member of the first contact and the conductive member of the second contact are disposed corresponding to each other. The conductive member of the first contact and the magnetic member of the second contact are disposed corresponding to each other. The two vacuum switch contacts are anti-symmetrically disposed, such that a rotating magnetic field having rotating lines of magnetic force is formed, so that re-ignition possibility during voltage breaking is effectively reduced, and an arc voltage is decreased.

7 Claims, 4 Drawing Sheets

VACUUM SWITCH TUBE

FIELD OF THE TECHNOLOGY

The present invention relates to a vacuum switch tube, and more particularly to a vacuum switch tube with corresponding contacts disposed in an arc-extinguishing chamber, which belongs to the field of electric technology.

BACKGROUND

A switch device is an essential device in a circuit, which functions to turn on and off the circuit. When the two contacts in a switch device are disconnected, an arc is generated, e.g., a plasma arc column with a conical surface is generated from the combustion at the cathode spot. Especially in a high voltage circuit, the arc generated between the switch contacts is extremely intense.

The arc raises the temperature of the switch, which wears the switch, and the current breaking capability of contacts is decreased because the arc occurs. Therefore, when the switch contacts are turned on and off, the arc-extinguishing process must be performed. In the switch device in the prior art, an arc-extinguishing medium such as oil, sulfur hexafluoride ($SF_6$), air, semiconductor, or vacuum is usually used for performing the arc-extinguishing process. Different arc-extinguishing media have different corresponding characteristics. As the vacuum switch has small gaps between the contacts, high voltage-resistant capability, low arc voltage, high current breaking capability, low electrical erosion, and long electrical endurance, the vacuum switch has been widely applied in various power circuits.

In the prior art, a vacuum switch tube usually includes two contacts sealed in a vacuum shell. Contact bodies of the two contacts respectively include a magnetic member and a conductive member joining and combining with each other. During the current breaking, a distance between the two contacts gradually increases, and a contact area between the contact bodies gradually decreases, until only one contact point is left between the contact bodies. At the same time, a contact resistance gradually increases, such that temperature of the area where the contact point is located gradually rises. Once the temperature is higher than a melting point of the contact point, the contact point is melted, evaporated, and ionized. The metal vapor maintains the discharging in vacuum, so as to generate a vacuum arc. At this time, the key point of the successful current breaking is that an insulation recovery speed at the gaps of the contact bodies is higher than a transient recovery voltage speed at the gaps of the contact bodies after the crossing zero of the arc current, such that re-ignition does not occur and the current breaking is successful. During the current breaking in the vacuum arc-extinguishing chamber, the metal vapor released by the arc diffuses rapidly during the crossing zero of the arc current and is condensed instantly upon encountering surfaces of the contact bodies or shielding case. Therefore, the influencing factors such as size, material, or form of contact bodies, gap between contact bodies, density of the metal vapor generated during current breaking, and density of charged particles need to be designed properly.

Generally speaking, a desirable vertical magnetic field formed between contact bodies through the magnetic members can accelerate the arc-extinguishing process, which can achieve excellent insulation recovery after arcing. However, in the current vacuum switch contacts, due to the restriction of structural shapes, it is usually very difficult to form a desirable vertical magnetic field for performing arc-extinguishing, and it is rather difficult to solve problems such as electric field concentration, insufficient voltage resistance, and high re-ignition possibility during the high voltage breaking process. For a high voltage circuit, the 36-kilovolt voltage breaking can be realized in the prior art. For a higher voltage circuit, particularly, 72-kilovolt high voltage circuit, currently, no vacuum switch tube structure is available for satisfying effective arc-extinguishing requirements during the breaking process. This is one of the problems to be solved in the vacuum switch technology in the prior art.

SUMMARY

The present invention is directed to a vacuum switch tube, which is applicable to reduce re-ignition possibility during voltage breaking, decrease an arc voltage, realize effective arc-extinguishing, and satisfy high voltage breaking requirements.

In order to realize the above objective, the present invention provides a vacuum switch tube, which includes a first conductive rod and a second conductive rod. A first contact is disposed at an end of the first conductive rod. A second contact is disposed at an end of the second conductive rod. The first contact and the second contact are sealed in a vacuum tube body and disposed facing each other. The first contact and the second contact are cylinders. The first contact and the second contact include conductive members and magnetic members extending in the same direction and joining with each other to form contact bodies respectively. The cross section shape of the magnetic members is divided by a neutrality line into two unequal regions. The magnetic member of the first contact and the conductive member of the second contact are correspondingly disposed, and the conductive member of the first contact and the magnetic member of the second contact are correspondingly disposed.

Preferably, a cross section of each of the contact bodies is equally divided into an upper left region, a lower left region, an upper right region, and a lower right region by its own vertical midline and horizontal midline. The upper right region is divided into a first upper right region neighboring the upper left region and a second upper right region other than the first upper right region. The lower left region is divided into a first lower left region neighboring the lower right region and a second lower left region other than the first lower left region. The conductive member is disposed in the first upper right region, the upper left region, and the second lower left region. The magnetic member is disposed in the first lower left region, the lower right region, and the second upper right region.

Preferably, the first upper right region and/or the first lower left region are half circles, a diameter edge of the first upper right region is adjacent to the upper left region, and a diameter edge of the first lower left region is adjacent to the lower right region. The shape of the half circle region also may be replaced by circle-crown, trapezoid or triangular.

Preferably, each of the contact bodies of the first contact and the second contact is disposed in a cylindrical metal shell respectively.

The contact bodies of the first contact and the second contact are respectively formed by a plurality of sheets laminated in sequence. Each of the sheets is formed by a conductive sheet and a magnetic sheet joining and combining with each other. A plurality of conductive sheets forms the conductive member. A plurality of magnetic sheets forms the magnetic member.

Furthermore, securing holes penetrating each of the sheets are further opened in the conductive sheets and the magnetic sheets. Securing columns are inserted in the securing holes.

One end of each of the securing columns is secured at a bottom portion inside the metal shell.

Alternatively, the contact bodies consist of a plurality of conductive and magnetic poles or particles adjacent each other closely.

The present invention provides a vacuum switch tube, in which the conductive members and the magnetic members form the contact bodies of the two contacts, and the shape of the magnetic members is unequal. Therefore, an uneven magnetic field is formed, in which one end of the magnetic field has a high intensity and the other end has a low intensity. In addition, since the magnetic members of the two vacuum switch contacts are anti-symmetrically disposed, when a magnetic field generated by the magnetic member of one vacuum switch contact and a magnetic field generated by the magnetic member of the other vacuum switch contact form a magnetic field loop, a rotating magnetic field having both a horizontal magnetic field and a vertical magnetic field and rotating lines of magnetic force is generated between the two vacuum switch contacts, so that the re-ignition possibility during voltage breaking is effectively reduced, the arc voltage is decreased, and the effective arc-extinguishing is realized, thereby satisfying the high voltage breaking requirements.

The present invention is further illustrated below in detail with reference to specific embodiments and accompanying drawings.

DETAILED DESCRIPTION

The present invention provides a vacuum switch tube, which includes a first conductive rod and a second conductive rod. A first contact is disposed at an end of the first conductive rod. A second contact is disposed at an end of the second conductive rod. The first contact and the second contact are sealed in a vacuum tube body and disposed facing each other. The first contact and the second contact are cylinders. The first contact and the second contact include conductive members and magnetic members extending in the same direction and joining with each other to form contact bodies respectively. The cross section shape of the magnetic members is divided by a neutrality line into two unequal regions. The technical solutions do not depart from the scope of the present invention, as long as the cross section shape of the magnetic members in the vacuum switch contacts has the above shape characteristics. The first contact and the second contact are anti-symmetrically disposed. That is, the magnetic member of the first contact and the conductive member of the second contact are correspondingly disposed. The conductive member of the first contact and the magnetic member of the second contact are correspondingly disposed. A structure of the vacuum switch tube of the present invention is illustrated in detail below with reference to specific embodiments.

First Embodiment of Vacuum Switch Tube

Figure 1:
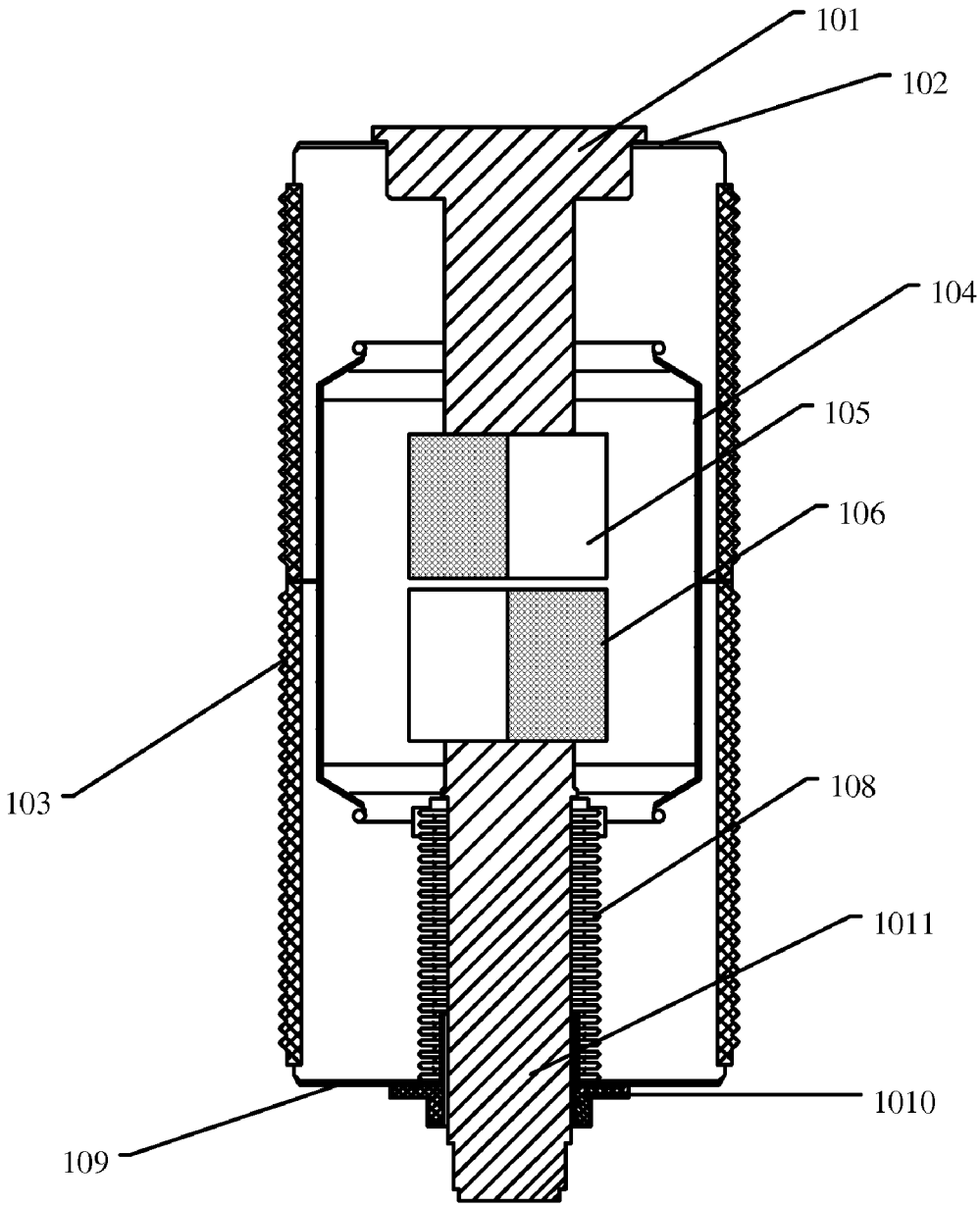
FIG. 1 is a schematic structural view of a vacuum switch tube according to a first embodiment of the present invention.

FIG. 1 is a schematic structural view of a vacuum switch tube according to a first embodiment of the present invention. As shown in FIG. 1, the vacuum switch tube includes an insulating housing 103, that is, a vacuum tube body. An upper end cover 102 and a lower end cover 109 are disposed at an upper end and a lower end of the insulating housing 103 respectively. Two conductive rods are disposed inside the insulating housing 103, which are a first conductive rod 1011 and a second conductive rod 101 respectively. A first contact 106 is disposed at an end of the first conductive rod 1011. The first conductive rod 1011 movably penetrates a through hole of the lower end cover 109 through a guide sleeve 1010. The guide sleeve 1010 is fixedly disposed in the through hole of the lower end cover 109. A through hole is opened in the guide sleeve 1010, so that the first conductive rod 1011 is enabled to movably penetrate there through. A sylphon bellowss 108 is further sleeved outside the first conductive rod 1011. The first conductive rod 1011 is connected to the guide sleeve 1010 through the sylphon bellowss 108. A second contact 105 is disposed at an end of the second conductive rod 101. The second conductive rod 101 is secured on the upper end cover 102 and is fixedly connected to a switch frame of the vacuum switch through screws and keeps still. The first contact 106 and the second contact 105 are disposed facing each other. An intermediate shielding case 104 is further disposed outside the second contact 105 and the first contact 106. A sylphon bellowss shielding case is further disposed between the sylphon bellowss 108 and the intermediate shielding case 104. As the sylphon bellowss 108 can be stretched out and drawn back, the leak-proofness of the vacuum switch tube during the movement of the first conductive rod 1011 can be ensured.

In the vacuum switch tube with the above structure, the connecting and disconnecting motions between the second contact and the first contact are realized through the movement of the first conductive rod. When the circuit needs to be turned on, the first conductive rod moves towards the second contact along an axis of the vacuum switch tube, and the second contact and the first contact are made to contact each other, so that the circuit is turned on. When the circuit needs to be turned off, the first conductive rod moves in a direction away from the second contact along the axis of the vacuum switch tube, such that the second contact and the first contact are separated from each other, thereby cutting off the current of the circuit.

In this embodiment, both the first contact and the second contact are cylinders, and arc-resistant layers are respectively coated on their own surfaces disposed facing each other. Particularly, the conductive members and the magnetic members in the two contacts are yin-yang-fish matched in shape. When the first contact and the second contact are disposed facing each other, the magnetic member of the first contact corresponds to the conductive member of the second contact, and the conductive member of the first contact corresponds to the magnetic member of the second contact, that is, the first contact and the second contact are anti-symmetrically disposed.

Figure 2:
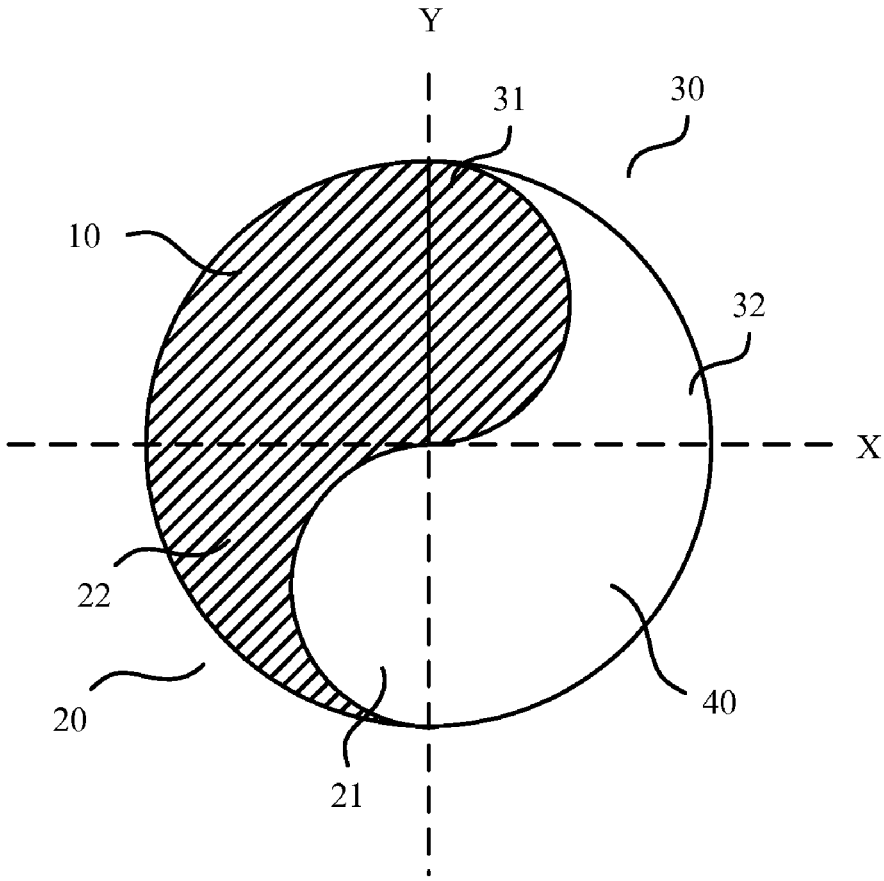
FIG. 2 is a schematic structural view of a cross section of a contact body of the vacuum switch tube according to the first embodiment of the present invention.

The shapes of yin-yang-fish cross sections in the contact bodies of the first contact and the second contact may be the same. Taking the first contact as an example, FIG. 2 is a schematic view of a cross section of a contact body of the vacuum switch tube according to the first embodiment of the present invention. The neutrality line is defined as follows: one region with arbitrary shape has a maximum characteristic length line. The region could be sandwiched between two parallel lines perpendicular to the characteristic length line, and the two parallel lines have a maximum distance and subject to a restriction that they could touch this region. A central line having the same distance depart from the two parallel lines is the neutrality line of this region. As shown in FIG. 2, when the cross section of the magnetic member is sandwiched between two parallel lines which have the maximum distance, the transverse central line X of the contact body is the neutrality line of the cross section shape of the magnetic member. As shown in FIG. 2, the cross section of the contact body is circular, and any one cross section is equally divided into an upper left region 10, a lower left region 20, an upper right region 30 and a lower right region 40 by its own vertical midline Y and horizontal midline X. The upper right region 30 is divided into a first upper right region 31 neighboring the upper left region 10 and a second upper right region 32 formed by an area other than the first upper right region 31. The lower left region 20 is divided into a first lower left region 21 neighboring the lower right region 40 and a second lower left region 22 formed by an area other than the first lower left region 21. The conductive material, for example, copper, is disposed in the first upper right region 31, the upper left region 10, and the second lower left region 22 to form the conductive member. The magnetic material, for example, iron, is disposed in the first lower left region 21, the lower right region 40, and the second upper right region 32 to form the magnetic member.

In this embodiment, the first upper right region 31 and the first lower left region 21 are half circles, a diameter edge of the half circle in the first upper right region 31 is adjacent to the upper left region 10, and a diameter edge of the half circle in the first lower left region 21 is adjacent to the lower right region 40. The diameter of the two half circles is equal to a radius of the cross section of the contact body where the half circles are located, and the specific shape is shown in FIG. 2, such that the conductive member and the magnetic member are configured into yin-yang-fish shapes joining and matching with each other. In this embodiment, the layout of the conductive members and the magnetic members of the contact bodies is designed into the yin-yang-fish shape, which facilitates to generate rotating lines of magnetic force on the contact surfaces, and enhances the high voltage breaking capability of the vacuum switch tube.

In the operating process of the vacuum switch tube, the magnetic member generates lines of magnetic force when the conductive member is incoming current. A distribution trend of the lines of magnetic force is flowing from a larger end to a smaller end of the yin-yang-fish shape. When the vacuum switch tube is applied, two contact bodies having the same structure are anti-symmetrically disposed, and the positions of the magnetic members are opposite. When a distance between the two contact bodies is smaller than half of a perimeter of the cross section of the contact body, the lines of magnetic force originally flowing from the larger end into the smaller end are changed to flow into a smaller end in the magnetic member of the other contact body. Therefore, the rotating lines of magnetic force are formed between the contact surfaces of the two contact bodies disposed facing each other. This solution is based on the principle that the lines of magnetic force always select the shortest path in distribution.

In this embodiment, the structure of the magnetic member is designed to enable lines of magnetic force to change from surrounding the circumference of one contact body to flow into the other contact body, so as to form a rotating magnetic field having both a horizontal magnetic field and a vertical magnetic field between the two contacts bodies. In addition, when the switch is turned off and the distance between the two contact bodies gradually increases, the vertical magnetic field still can be maintained. Therefore, the vacuum switch tube with the above structure design can provide a vertical magnetic field for realizing effective arc-extinguishing, so that the arc-extinguishing capability is enhanced, the re-ignition possibility during voltage breaking is reduced and the arc voltage is further decreased accordingly, thereby satisfying the high voltage breaking requirements. The technical solution in this embodiment can realize the capability of breaking voltages of higher than 40.5 kilovolts, for example, 55 kilovolts, 72.5 kilovolts, and 110 kilovolts.

In this embodiment, as the internal magnetic resistance of the contact bodies is much smaller than that of the vacuum environment, when the distance between the contact bodies is smaller than half of the perimeter of the cross section on the opposite surfaces of the two contacts bodies disposed facing each other, a condition of generating the vertical magnetic field is satisfied. Lines of magnetic force at remote ends of the two contact bodies may be transferred from the interior of the contact bodies to the opposite surfaces of the two contact bodies disposed facing each other.

Particularly, the shape of the conductive members and the magnetic members in the contact bodies is not limited to be yin-yang-fish matched. When the cross section of the contact bodies is divided by using the above way, the shape of the half circle regions also may be replaced by circle-crown, trapezoid, triangular, polygon, trapezoid-like or other shapes.

Second Embodiment of Vacuum Switch Tube

Figure 3:
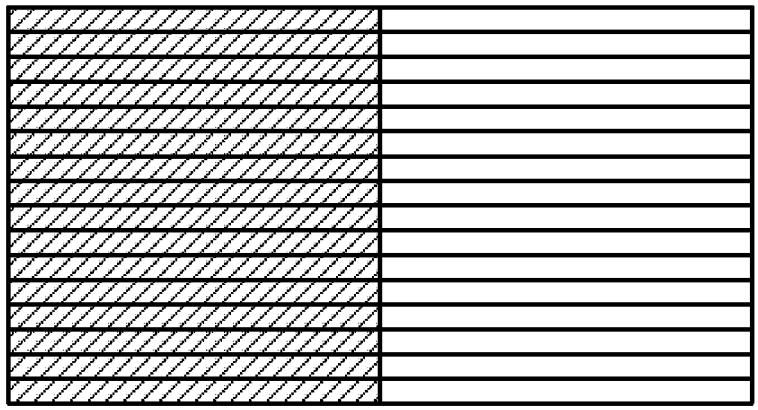
FIG. 3 is a schematic structural side view of a contact body of a vacuum switch tube according to a second embodiment of the present invention.

FIG. 3 is a schematic structural side view of a contact body of a vacuum switch tube according to a second embodiment of the present invention. In this embodiment, contact bodies of the first contact and the second contact are both formed by a plurality of sheets laminated in sequence. Taking the first contact as an example, each of the sheets is formed by a conductive sheet and a magnetic sheet joining and combining with each other. A plurality of conductive sheets forms the conductive member. A plurality of magnetic sheets forms the magnetic member. The shapes of cross sections of the conductive sheets and the magnetic sheets and a structural relation between the conductive member and the magnetic member may adopt the technical solution in the above embodiment, in which the shapes of the cross sections of the conductive sheets and the magnetic sheets are yin-yang-fish matched. All the sheets are laminated together to form a shape of an external profile of the contact body, as shown in FIG. 3. Outside of the contact bodies of the first contact and the second contact, cylindrical metal shells may be further disposed respectively, such that the contacts are disposed in the metal shells to form a vacuum switch tube.

Third Embodiment of Vacuum Switch Tube

Figure 4:
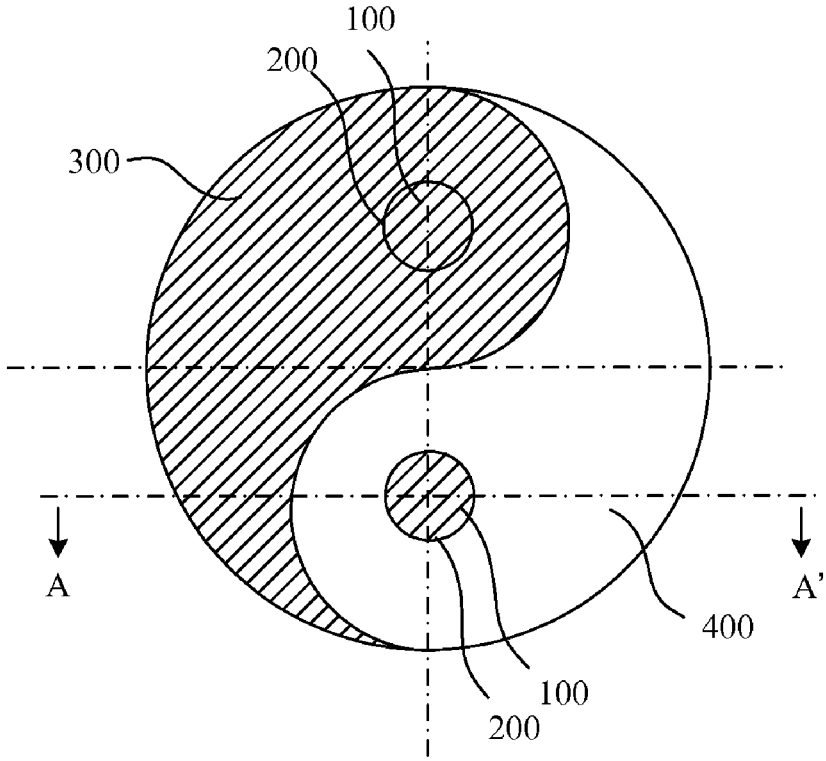
FIG. 4 is a schematic structural view of a cross section of a contact body of a vacuum switch tube according to a third embodiment of the present invention.
Figure 5:
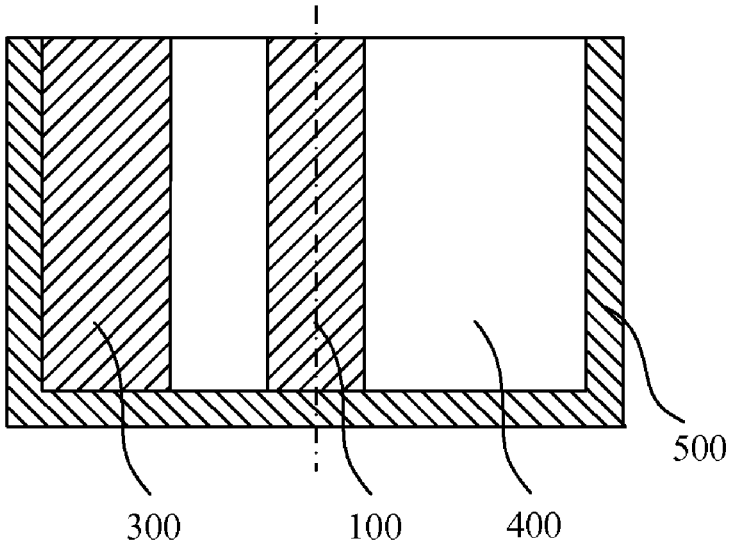
FIG. 5 is a schematic structural view of a cross section of the contact body along line A-A' in FIG. 4 according to the third embodiment of the present invention.

FIG. 4 is schematic structural view of a cross section of a contact body of a vacuum switch tube according to a third embodiment of the present invention. On the basis of the second embodiment, in order to secure relative positions of the conductive member and the magnetic member before the sheets are melted and solidified, securing holes 200 penetrating the plurality of sheets may be further opened in the conductive sheets 300 and the magnetic sheets 400. Securing columns 100 are inserted in the securing holes 200, as shown in FIG. 4, and one end of each of the securing columns 100 is secured at a bottom portion inside the metal shell 500. The securing columns 100 may be made of the same material as the conductive member, for example, copper.

The contact bodies are not limited to consist of sheets, and the contact bodies also may be consist of a plurality of conductive and magnetic poles or particles adjacent each other closely.

The technical solution in this embodiment simplifies the manufacturing process of the contact bodies. After a plurality of sheets is prepared through a simple molding process, the sheets may be put in a metal shell corresponding to the profile of the conductive member and the magnetic member. Then, a large current is supplied to generate heat for heating the metal in the sheets, so that the metal in the sheets is melt, and then solidified when the temperature drops, so as to form the conductive member and the magnetic member respectively.

Finally, it should be noted that the above embodiments are merely provided for describing the technical solutions of the present invention, but not intended to limit the present invention. It should be understood by persons of ordinary skill in the art that although the present invention has been described in detail with reference to the preferred embodiments, modifications or equivalent replacements can still be made to the technical solutions of the present invention, as long as such modifications or equivalent replacements do not cause the modified technical solutions to depart from the spirit and scope of the present invention.

What is claimed is:

1. A vacuum switch tube, comprising: a first conductive rod and a second conductive rod, wherein a first contact is disposed at an end of the first conductive rod, a second contact is disposed at an end of the second conductive rod, and the first contact and the second contact are sealed in a vacuum tube body and disposed facing each other; the first contact and the second contact are cylinders, and the first contact and the second contact comprise conductive members and magnetic members extending in the same direction and joining with each other to form contact bodies respectively; the cross section shape of the magnetic members is divided by a neutrality line into two unequal regions; and the magnetic member of the first contact and the conductive member of the second contact are correspondingly disposed, and the conductive member of the first contact and the magnetic member of the second contact are correspondingly disposed.

2. The vacuum switch tube according to claim 1, wherein a cross section of each of the contact bodies is equally divided into an upper left region, a lower left region, an upper right region, and a lower right region by a vertical midline and a horizontal midline thereof; the upper right region is divided into a first upper right region neighboring the upper left region and a second upper right region other than the first upper right region; the lower left region is divided into a first lower left region neighboring the lower right region and a second lower left region other than the first lower left region; the conductive member is disposed in the first upper right region, the upper left region and the second lower left region, and the magnetic member is disposed in the first lower left region, the lower right region and the second upper right region.

3. The vacuum switch tube according to claim 2, wherein the first upper right region and/or the first lower left region are half circles, a diameter edge of the first upper right region is adjacent to the upper left region, and a diameter edge of the first lower left region is adjacent to the lower right region.

4. The vacuum switch tube according to claim 1, wherein each of the contact bodies of the first contact and the second contact is disposed in a cylindrical metal shell respectively.

5. The vacuum switch tube according to claim 4, wherein the contact bodies of the first contact and the second contact are respectively formed by a plurality of sheets laminated in sequence, each of the sheets is formed by a conductive sheet and a magnetic sheet joining and combining with each other, a plurality of conductive sheets forms the conductive member, a plurality of magnetic sheets forms the magnetic member.

6. The vacuum switch tube according to claim 5, wherein securing holes penetrating each of the sheets are opened in the conductive sheets and the magnetic sheets, securing columns are inserted in the securing holes, and one end of each of the securing columns is secured at a bottom portion inside the metal shell.

7. The vacuum switch tube according to claim 4, wherein the contact bodies consist of a plurality of conductive and magnetic poles or particles adjacent each other closely.

* * * * *